United States Patent [19]

Shoup, Jr. et al.

[11] 4,029,436

[45] June 14, 1977

[54] BLADE ROOT FEATHER SEAL

[75] Inventors: Edgar C. Shoup, Jr., Glastonbury; Vincent Colletti, Jr., Rocky Hill, both of Conn.

[73] Assignee: United Technologies Corporation, Hartford, Conn.

[22] Filed: June 17, 1975

[21] Appl. No.: 587,787

[52] U.S. Cl. ..... 416/193 A; 416/221

[51] Int. Cl.[2] ..... F01D 5/30

[58] Field of Search ..... 416/193, 193 A, 221, 416/220, 219

[56] References Cited

UNITED STATES PATENTS

| | | | |
|---|---|---|---|
| 2,937,849 | 5/1960 | Danforth | 416/221 |
| 2,942,842 | 6/1960 | Hayes | 416/221 |
| 3,202,398 | 8/1965 | Webb | 416/193 A X |
| 3,266,771 | 8/1966 | Morley | 416/193 A X |
| 3,295,825 | 1/1967 | Hall | 416/193 A X |
| 3,446,482 | 5/1969 | Kydd | 416/193 A X |
| 3,709,631 | 1/1973 | Karstensen et al. | 416/221 X |
| 3,752,598 | 8/1973 | Bowers et al. | 416/193 A X |

FOREIGN PATENTS OR APPLICATIONS

| | | | |
|---|---|---|---|
| 556,458 | 10/1957 | Belgium | 416/193 |
| 1,032,753 | 6/1958 | Germany | 416/221 |
| 1,079,073 | 4/1960 | Germany | 416/221 |
| 671,960 | 5/1952 | United Kingdom | 416/193 A |
| 924,808 | 5/1963 | United Kingdom | 416/221 |

*Primary Examiner*—Everette A. Powell, Jr.
*Attorney, Agent, or Firm*—Charles A. Warren

[57] ABSTRACT

A bladed rotor having blade slots in the periphery and peripheral lands between the slots, has a row of blades positioned in the slots with laterally extending platforms on the blades overlying the lands, the circumferential space between the outer edges of adjacent platforms, which space is radially outward of the associated lands, is closed by a flexible thin seal held axially and circumferentially in position under the space between the platforms.

9 Claims, 3 Drawing Figures

BLADE ROOT FEATHER SEAL

SUMMARY OF THE INVENTION

High performance axial flow turbines or compressors require structures that minimize gas leakages or gas recirculation that result in power losses. Even small losses, if avoided, will improve performance. One loss is the gas leakage or recirculation in and through the space between the outer axially extending edges of the platforms of adjacent blades on the disk. The present invention involves a seal by which to close this space thereby minimizing a loss of cooling air and/or preventing any gas recirculation. Such a seal serves either to improve performance and/or by the resultant improved cooling, permitting a downgrading of the blade or disk material by the resulting improved temperature levels. The invention contemplates a single inexpensive seal that will be held in sealing position by centrifugal force and will be dependably effective, at the same time permitting easy assembly, easy inspection and fail-safe operation.

The foregoing and other objects, features and advantages of the present invention will become more apparent in the light of the following detailed description of the preferred embodiments thereof as illustrated in the accompanying drawing.

DESCRIPTION OF THE PREFERRED EMBODIMENT

Figure 1:
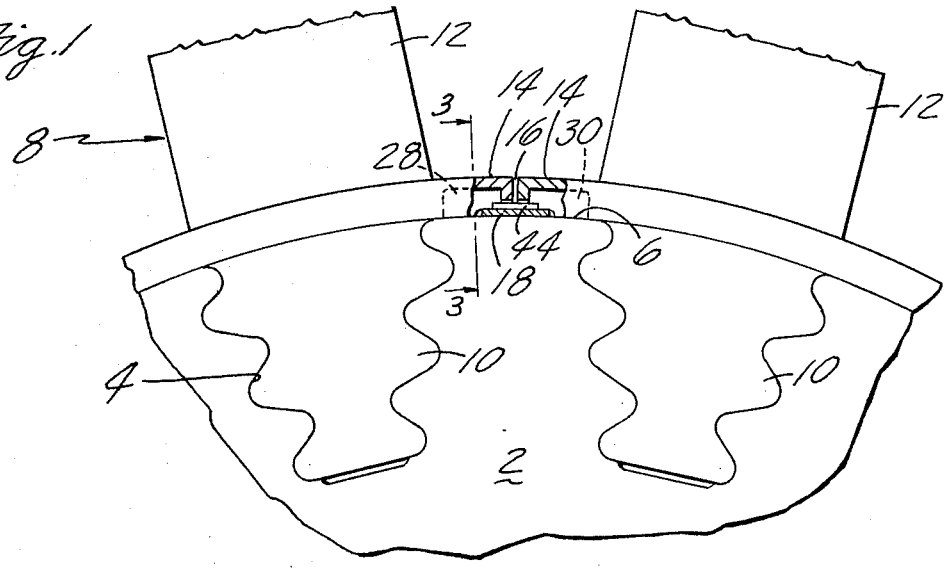
FIG. 1 is a fragmentary side view of a rotor embodying the invention with parts broken away along the line 1—1 of FIG. 3.
Figure 2:
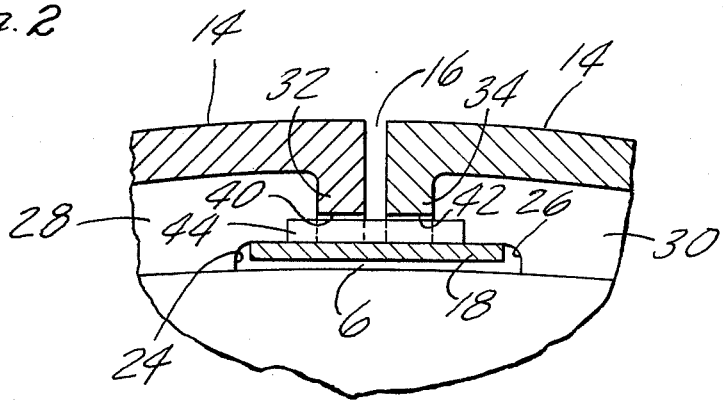
FIG. 2 is an enlarged view of a portion of FIG. 1.

Referring to FIGS. 1 and 2, the rotor, only a portion of which is shown, includes a disk 2 having a row of axially extending blade root receiving slots 4 in its periphery. The slots shown by way of example are conventional fir-tree slots. Between adjacent slots the disk has peripheral lands 6. Blades 8 have roots 10 positioned in the slots and operative blade elements 12 extending radially outward from the roots. Positioned on the blades at the outer ends of the roots and radially inward of the blade elements 12 are laterally extending blade platforms 14 that extend toward and into closely spaced relation to the platforms on adjacent disks. The clearance space 16 between the platforms provides for thermal expansion and blade assembly and overlies the associated land on the disk. The platforms closely overlie the lands on the disk as shown.

Positioned between the lands and the overlying platforms are seals 18, preferably thin, flexible, sheet material that extend the length of the lands and have end flanges 20 and 22 to engage, respectively, the platform and side of the disk adjacent the land to hold the seals in axial position. When the rotor is in operation these seals are urged against the undersides of the platforms by centrifugal force and being flexible will bend to fit securely against the platforms.

The undersides of the platforms may have flat grooves 24 and 26 therein, deep enough to receive the seal and wide enough to accept the seal and to hold the seal centrally located with relation to the clearance space 16. The grooves 24 and 26, when utilized, permit the remainder of the undersides of the platforms to be closer to the lands thereby further minimizing undesired air or gas flow through the rotor. The grooves are preferably deep enough to allow a small clearance radially for the seal.

Figure 3:
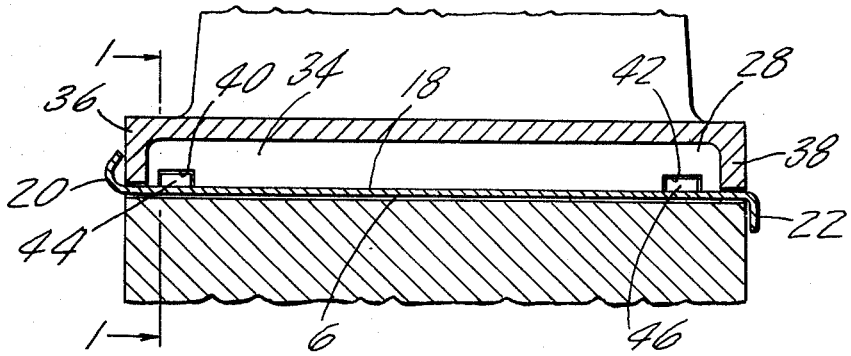
FIG. 3 is a sectional view along line 3—3 of FIG. 1.

The undersides of the platforms may also be recessed as at 28 and 30 between opposite ends to leave a transverse flange 32, 34 at the outer edge of the platform and end flanges 36 and 38, FIG. 3. This provides a narrow flange along the underside of each of the platforms at their contiguous edges as shown for engagement by the seal. This narrower surface improves seal contact as will be understood.

These flanges 32 and 34 may have notches 40 and 42 therein, FIG. 3, such notches in adjacent flanges being in alignment. The seal 18 may have ribs 44 and 46 on the outer surface to fit in these notches and further locate the seal axially, particularly if either of the end flanges on the seals are broken. There is clearance between the notches and ribs to permit radial movement of the seal for best sealing.

This construction as will be understood is relatively simple and requires little modification of an existing rotor structure to be utilized. The seal is effective during rotor operation, may be readily positioned on the blading during assembly and may be readily inspected at routine engine inspections. Since this seal prevents loss of cooling air from the space radially inward of the seal, the cooling of the rotor is improved and thus may permit use of a less exotic material for rotor or blade thereby reducing rotor cost.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A rotor construction including:
   - a disk having a plurality of axially extending blade root receiving slots in its periphery with peripheral lands between the slots,
   - a plurality of blades having roots positioned in the slots with blade platforms on each blade extending circumferentially toward the platforms on adjacent blades and overlying the peripheral lands, adjacent platforms terminating in closely spaced relation to one another, and
   - a thin flexible, flat seal element positioned between each land and the overlying blade platforms and extending across the space between the adjacent platforms, said seal having means thereon to locate each seal element axially of the disk, the undersides of the platforms having recesses therein to form narrow flanges adjacent the outer edges of the platforms to engage the seal element, the narrow flanges being significantly narrower than the seal element to reduce the area of the seal element engaged thereby.

2. A rotor construction as in claim 1 in which the undersides of adjacent blade platforms are grooved to receive the seal element and locate it circumferentially of the disk, the width of the cooperating grooves in adjacent blade platforms corresponding substantially to the width of the seal element.

3. A rotor construction as in claim 2 in which the grooves are substantially the same depth as the thickness of the seal.

4. A rotor construction as in claim 1 in which said flanges are notched and the seal element has at least one transverse rib engaging in the cooperating notch to retain the seal in axial position.

5. A rotor construction as in claim 1 in which the undersides of the platforms have aligned notches therein and the seal has a transverse rib to engage the notches for locating the seal in position.

6. A rotor construction as in claim 2 in which the seal has end flanges for additionally retaining the seal in position axially of the disk.

7. The combination with a bladed rotor including a rotor having a row of axially extending blade root receiving slots on its periphery and peripheral lands between the slots, and a row of blades on the disk periphery having roots fitting in the slots and operative blade elements extending outwardly therefrom, each blade having platforms thereon overlying the lands on the disk and the platforms of adjacent blades being closely spaced from one another to form a space overlying the land, of a seal element located between each land and the overlying platforms and extending across said space, said element being thin and flexible and having means to locate said seal axially of the disk, said means including a transverse rib on the element between its ends and a notch in the underside of the platform to receive the transverse rib.

8. The combination as in claim 7 in which the undersides of the platforms are grooved to provide a space to receive the seal element.

9. The combination as in claim 7 in which the undersides of the platforms are grooved to receive the seal element, the width of the cooperating grooves in adjacent platforms corresponding substantially to the width of the seal element, and the depth of the grooves being substantially the same as the thickness of the seal element.

* * * * *